US010359154B2

(12) United States Patent
Zhang et al.

(10) Patent No.: US 10,359,154 B2
(45) Date of Patent: Jul. 23, 2019

(54) ASSEMBLY INCLUDING A DIFFUSER FOR A LIGHTING DEVICE

(71) Applicant: LEDVANCE GmbH, Garching bei München (DE)

(72) Inventors: Dezhao Zhang, Shenzhen (CN); Jun Liu, Shenzhen (CN); Moritz Engl, Regensburg (DE); Ming Tao Wang, Shenzhen (CN)

(73) Assignee: LEDVANCE GMBH, Garching Bei München (DE)

( * ) Notice: Subject to any disclaimer, the term of this patent is extended or adjusted under 35 U.S.C. 154(b) by 0 days.

(21) Appl. No.: 16/259,303

(22) Filed: Jan. 28, 2019

(65) Prior Publication Data

US 2019/0154211 A1 May 23, 2019

Related U.S. Application Data

(63) Continuation of application No. 14/773,364, filed as application No. PCT/EP2014/052936 on Feb. 14, 2014, now Pat. No. 10,190,727.

(30) Foreign Application Priority Data

Mar. 7, 2013 (CN) ..... 2013 1 0073486

(51) Int. Cl.

| | |
|---|---|
| ***F21K 9/00*** | (2016.01) |
| ***F21K 9/275*** | (2016.01) |
| ***F21S 4/28*** | (2016.01) |
| ***F21V 17/16*** | (2006.01) |
| ***F21K 9/66*** | (2016.01) |
| ***F21K 9/60*** | (2016.01) |
| ***F21V 23/06*** | (2006.01) |

(Continued)

(52) U.S. Cl.

CPC ..... *F21K 9/275* (2016.08); *F21K 9/60* (2016.08); *F21K 9/66* (2016.08); *F21S 4/28* (2016.01); *F21V 3/049* (2013.01); *F21V 3/0625* (2018.02); *F21V 3/10* (2018.02); *F21V 17/164* (2013.01); *F21V 23/06* (2013.01); *F21V 29/70* (2015.01); *F21Y 2103/10* (2016.08); *F21Y 2115/10* (2016.08)

(58) Field of Classification Search

CPC ..... F21S 4/28; F21V 29/70

See application file for complete search history.

(56) References Cited

U.S. PATENT DOCUMENTS 6,361,186 B1 * 3/2002 Slayden ..... F21V 3/02 362/241

2009/0219713 A1 9/2009 Siemiet et al.

(Continued)

FOREIGN PATENT DOCUMENTS

CN 201306626 Y 9/2009

CN 201475683 U 5/2010

(Continued)

*Primary Examiner* — Gerald J Sufleta, II

(74) *Attorney, Agent, or Firm* — Hayes Soloway PC

(57) ABSTRACT

Various embodiments may relate to a lighting device, which includes a lamp tube having two open ends, a light engine arranged in the lamp tube, a carrier supporting the light engine, and two end caps closing the open ends. The lighting device further includes a diffuser. The carrier supporting the light engine is held on the diffuser, and the diffuser is held on the inner wall of the lamp tube.

20 Claims, 3 Drawing Sheets

(51) Int. Cl.

| | |
|---|---|
| ***F21V 3/04*** | (2018.01) |
| ***F21V 3/06*** | (2018.01) |
| ***F21V 3/10*** | (2018.01) |
| ***F21V 29/70*** | (2015.01) |
| *F21Y 115/10* | (2016.01) |
| *F21Y 103/10* | (2016.01) |

(56) References Cited

U.S. PATENT DOCUMENTS

| | | | | |
|---|---|---|---|---|
| 2010/0220469 | A1 | 9/2010 | Ivey et al. | |
| 2010/0321921 | A1* | 12/2010 | Ivey | F21K 9/64 362/84 |
| 2012/0099302 | A1* | 4/2012 | Kim | F21K 9/27 362/218 |
| 2013/0033888 | A1 | 2/2013 | Van Der Wel et al. | |
| 2013/0094200 | A1 | 4/2013 | Dellian et al. | |
| 2013/0229104 | A1 | 9/2013 | Green et al. | |
| 2015/0146419 | A1* | 5/2015 | Huang | F21V 21/22 362/218 |

FOREIGN PATENT DOCUMENTS

| | | | |
|---|---|---|---|
| CN | 102748626 | A | 10/2012 |
| CN | 102859271 | A | 1/2013 |
| WO | 2012000860 | A1 | 1/2012 |
| WO | 2012001645 | A1 | 1/2012 |
| WO | 2014135357 | A1 | 9/2014 |

* cited by examiner

ASSEMBLY INCLUDING A DIFFUSER FOR A LIGHTING DEVICE

CROSS-REFERENCE TO RELATED APPLICATIONS

This patent application is a Continuation of U.S. patent application Ser. No. 14/773,364, filed on Sep. 7, 2015, which is a national stage entry according to 35 U.S.C. § 371 of PCT Application No. PCT/EP2014/052936, filed on Feb. 14, 2014, which claims priority from Chinese Patent Application No. 201310073486.7, filed on Mar. 7, 2013. Each of these patent applications is herein incorporated by reference in its entirety.

TECHNICAL FIELD

Various embodiments generally relate to a lighting device, particularly a retrofit lamp.

BACKGROUND

It is well known that LED illumination has non-substitutable advantages such as energy saving, ultra low power consumption, an almost 100% electro-optical power conversion, 80% or higher energy saving compared with traditional light sources at the same luminous efficiency, and a relatively long service life. Considering the advantages mentioned above, LEDs are more and more used as light sources, for example, LED retrofit lamps appearing in the market in a great number. Such LED retrofit lamps possess a contour of traditional light sources, an incandescent lamp or a lamp tube for instance, and can thus be better adapted to an existing lighting system as light source.

In an existing technical solution of retrofit lamps for replacing traditional lamp tubes, the retrofit lamp has a lamp tube made of a transparent plastic, an LED light engine as light source is arranged inside said lamp tube, an additional holding structure is hereby usually required to fix the LED light engine, and said holding structure arranges the LED light engine on end caps closing two open ends of the lamp tube. In another existing technical solution, the retrofit lamp, viewed from a cross section thereof, includes two parts, viz. a lamp cover of a transparent plastic and a heat sink that is assembled together with the lamp cover and used for an LED light engine, wherein the heat sink and the transparent lamp cover are assembled to form a cylindrical structure. Hereby, both the heat sink and the transparent lamp cover require a specifically configured mounting structure, so that good leak tightness is assured, while the two are reliably fixed together. However, the above solutions have certain obvious disadvantages, viz. the holding structure has to be specifically configured, which increases the cost of the retrofit lamp resulting in complexity and difficulty of assembly. In addition, a lamp tube made of plastics has relatively bad flexural behavior and might have undesired bend in case of a relatively long lamp tube. In order to solve said problem, the heat sink has to be configured to be relatively heavy, which increases the cost of the retrofit lamp. Moreover, a plastic lamp cover has relatively bad optical performance, and complex configurations have to be performed on the plastic lamp cover to obtain desired light distribution performance, which further increases the cost of the retrofit lamp.

SUMMARY

Various embodiments provide a lighting device, particularly a retrofit lamp. The lighting device according to various embodiments requires low cost and has a simple structure. Moreover, the lighting device according to various embodiments is easier to assemble and has fine light distribution performance, while sufficient structural strength is insured.

A lighting device may include: a lamp tube having two open ends; a light engine arranged in the lamp tube; a carrier supporting the light engine; and two end caps closing the open ends, wherein the lighting device further includes a diffuser, the carrier supporting the light engine is held on the diffuser, and the diffuser is held on the inner wall of the lamp tube. In various embodiments, a diffuser is used, in order to obtain good light distribution performance, while said diffuser also functions for positioning the light engine and the carrier supporting the light engine inside the lamp tube, so that the specifically configured holding structure used in the related art can be omitted. It significantly reduces the manufacturing cost of the lighting device according to various embodiments.

It is provided according to various embodiments that the diffuser is configured to be elastic and rests on the inner wall of the lamp tube in a predetermined stress. In various embodiments, the diffuser per se is configured to be capable of expanding outwardly in a radial direction of the lamp tube. After the diffuser is placed inside the lamp tube, the expansion trend of the diffuser in the radial direction is limited by the inner wall, thereby forming a predetermined stress between the inner wall of the lamp tube and the diffuser; in other words, the diffuser exerts an abutting force on the inner wall of the lamp tube, which force assures that the diffuser, then the carrier held on the diffuser which supports the light engine would not move relative to the inner wall of the lamp tube.

According to various embodiments, it is provided that the diffuser is a tubular structure formed by bending an elastic plate-shaped part. In such a simplest embodiment, the diffuser bend into a tubular structure is similar to a curved leaf spring, and the restoring force of the leaf spring prompts the formation of the abutting force or the predetermined stress.

In various embodiments, the diffuser extends over the whole longitudinal length of the lamp tube. Thus, the diffuser covers the light emergent surface of the lamp tube over the whole longitudinal length to obtain hereby a large effective lighting region as possible.

It is further provided according to various embodiments that the lamp tube is a glass tube. Glass tubes are widely used in different fluorescent lamp tubes, as they require low costs and can be obtained from the market with low prices. Moreover, glass tubes have better flexural behavior compared with plastic lamp tubes. In this case, the heat sink for heat dissipation can be configured to be relatively light, under the precondition that the demands on heat dissipation are satisfied. Furthermore, glass tubes have finer optical performance.

In various embodiments, the carrier is a heat sink. In various embodiments, said heat sink can be made of aluminum, which is a relatively light in weight. Of course, the heat sink can also be made of other materials such as heat conductive plastics, etc.

In various embodiments, the heat sink is fixed on the diffuser. The diffuser according to various embodiments is made of an elastic plate-shaped part. Thus, while fixing the heat sink, only one edge of the plate-shaped part has to be fixed with the heat sink, and there is no need to fix the other edge with the heat sink, so as to ensure that the diffuser bent into a tubular shape can further have an expansion trend after being fixed on the heat sink.

It is further provided according to various embodiments that the light engine includes a circuit board and at least one LED chip arranged on the circuit board. LED chips have advantages of high luminous efficiency, environmental protection and long service life.

In various embodiments, the circuit board extends over the whole longitudinal length of the lamp tube, so that LED chips arranged on the circuit board are also successively distributed in the longitudinal direction of the circuit board, and then be enabled to uniformly output light in the longitudinal direction of the whole lighting device.

In various embodiments, the light engine is arranged in a space defined by the heat sink and the diffuser, so that light emitted by the LED chip emerges through the diffuser. Through such an arrangement way, an observer would not view the LED chips from outside, which improves the aesthetic property of the lighting device. Moreover, light emitted by the LED chips would not emerge directly through the lamp tube, which avoids detrimental influence on the light distribution performance.

According to various embodiments, it is provided that the diffuser includes a plate-shaped part base body which is made of a transparent and elastic material, wherein said material can be PC or PET material, and can certainly be other transparent and elastic materials.

In various embodiments, a microstructure is formed on the surface of the plate-shaped part base body, and the microstructure is configured to enable light that emerges through the diffuser to have uniform light distribution performance. For example, a frosted surface, etc., can be formed on the surface of the base body in a sheet form.

Alternatively, a diffusant, e.g., white powder, etc., is added to the material forming the plate-shaped part base body, so that emergent light through the diffuser has uniform light distribution performance.

According to various embodiments, it is provided that a pin for insertion into a socket is formed on the end cap, wherein the pin is in electrical connection with the light engine through a lead. In various embodiments, the end cap functions for closing the open end of the lamp tube and providing electrical connection with the light engine. Such an end cap has the same contour as end caps used in traditional fluorescent lamps, so that the lighting device according to various embodiments can be easily inserted into a socket provided in a traditional fluorescent lamp tube.

In various embodiments, the end cap is made of an insulating material.

According to various embodiments, it is provided that the lighting device is configured as a T5, T8, and T10 retrofit lamp.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

In the following detailed description, reference is made to the accompanying drawings, which form a part thereof, and in which is shown by way of illustration specific embodiments in which the invention may be practiced. In this regard, directional terminology, such as "inside," "outside," "left," "right," is used in reference to the orientation of the figures being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
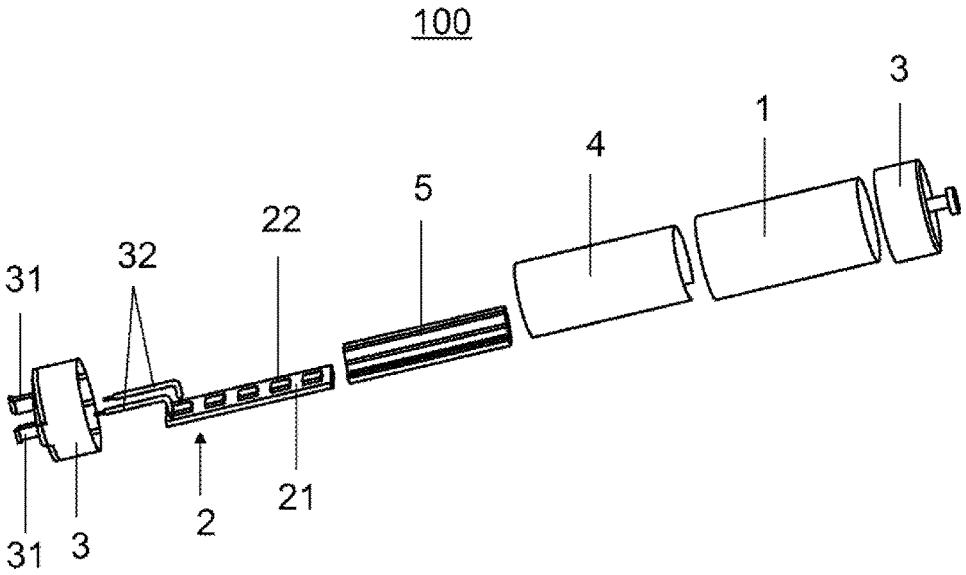
FIG. 1 is an exploded schematic diagram of a lighting device according to the present disclosure.

FIG. 1 shows an exploded schematic diagram of a lighting device 100 according to various embodiments, and it can be seen from the figure that the lighting device 100 includes: a lamp tube 1 having two open ends; a light engine 2 arranged in the lamp tube 1; a carrier supporting the light engine 2; and two insulating end caps 3 closing the open ends. Moreover, it can be seen from the figure that the lighting device 100 further includes a diffuser 4. The lighting device 100 according to various embodiments is configured as an LED retrofit lamp, particularly a T5, T8 or T10 retrofit lamp. The light engine 2 is thereby configured as an LED light engine and includes a circuit board 21 and at least one LED chip 22 arranged on the circuit board 21. It can further be seen from the figure that a plurality of LED chips 22 is provided on the circuit board 21. In addition, the circuit board 21 extends over the whole longitudinal length of the lamp tube 1. However, only a section of the circuit board 21 is shown in the view of FIG. 1, while in an actual situation, the circuit board 21 shall extend from one end cap 3 to the side of another opposite end cap 3.

Moreover, in the example as shown in FIG. 1, the end cap 3, particularly the left end cap 3 in FIG. 1, has a pin 31 for insertion into a socket, wherein the pin 31 is in electrical connection with the circuit board 21 of the light engine 2 through a lead 32. In various embodiments, the end cap 3 functions for closing the open end of the lamp tube 1 and providing electrical connection with the light engine 2. Such an end cap 3 has the same contour as end caps used in traditional fluorescent lamps, so that the lighting device 100 according to various embodiments can be easily inserted into a socket provided in a traditional fluorescent lamp tube. However, there is a slight difference between the right end cap 3 and the left end cap 3 in FIG. 1, viz. only a bolt is formed on said right end cap, and the function of said bolt only lies in fixation of the lamp tube in the socket, while no electrical connection is provided. However, said right end cap 3 can also have the same structure as the left end cap 3, while there is just no need to perform electrical connection with the circuit board 21 of the light engine 2 through a lead.

Figure 2:
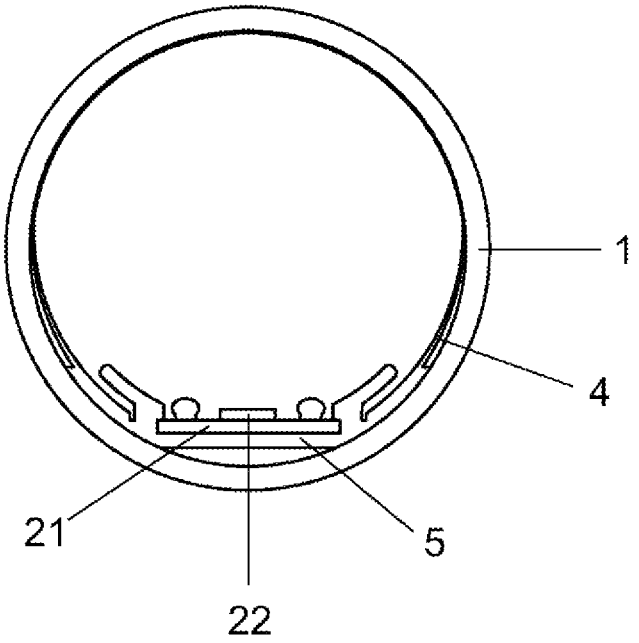
FIG. 2 is a sectional view of the lighting device according to the present disclosure.

Furthermore, the circuit board 21 shown in FIG. 1 is supported on the carrier (see FIG. 2). Said carrier is configured as a heat sink 5. In the present example, the heat sink 5 is made of aluminum, which is relatively light in weight. Of course, the heat sink 5 can also be made of other materials such as heat conductive plastics, etc.

In addition, the lamp tube 1 is a glass tube. The glass tube 1 is widely applied to different fluorescent lamp tubes, as it requires low cost and can be obtained from the market with low price. Moreover, the glass tube 1 has better flexural behavior compared with plastic lamp tubes, and the heat sink for heat dissipation can therefore be configured to be relatively light, under the precondition that the requirements on heat dissipation are satisfied. Furthermore, a glass tube has finer optical performance.

The key point of the present disclosure lies in the diffuser 4. The diffuser 4 according to various embodiments is a tubular structure formed by bending an elastic plate-shaped part. However, in the example as shown in FIG. 1, said diffuser 4 is not formed as a closed tubular structure, instead of that, there is a certain distance between the two opposite ends. In the present example, said diffuser 4 includes a plate-shaped base in a sheet form that is made of a transparent and elastic material, said material is PC or PET material, and can certainly be other transparent and elastic materials. In a specific example, a microstructure is formed on the surface of the plate-shaped base body, in order to obtain uniform light distribution performance, while in other examples, a diffusant, e.g., white powder, etc., can be added to the material forming the plate-shaped base body. In addition, the diffuser 4 extends over the whole longitudinal length of the lamp tube 1. Hereby, the diffuser 4 covers the light emergent surface of the lamp tube 1 in the whole longitudinal length, so as to obtain a large effective lighting region as possible.

FIG. 2 shows a sectional view of the lighting device 100 according to various embodiments. It can be seen from the figure that the heat sink 5 is fixed on the diffuser 4. The diffuser 4 according to various embodiments is made of an elastic plate-shaped part. Thus, while fixing the heat sink 5, only one edge of the plate-shaped part has to be fixed with the heat sink 5, and there is no need to fix the other edge with the heat sink 5, so as to ensure that the diffuser 4 bent into a tubular shape can further have an expansion trend after being fixed on the heat sink 5. It can be seen from the figure that the diffuser 4 with the heat sink 5 is inserted into the lamp tube 1, and the diffuser 4 rests on the inner wall of the lamp tube 1 in a predetermined stress. The diffuser 4 per se is configured to be capable of expanding outwardly in a radial direction of the lamp tube 1. After the diffuser 4 is placed inside the lamp tube 1, the expansion trend of the diffuser 4 in the radial direction is limited by the inner wall, thereby forming a predetermined stress between the inner wall of the lamp tube 1 and the diffuser 4; in other words, the diffuser 4 exerts an abutting force on the inner wall of the lamp tube, which force assures that the diffuser 4, then the heat sink 5 held on the diffuser 4 which supports the light engine 2 would not move relative to the inner wall of the lamp tube.

Moreover, it can further be seen from FIG. 2 that the light engine 2 is arranged in a space defined by the heat sink 5 and the diffuser 4, so that light emitted by the LED chip 22 emerges through the diffuser 4.

Figure 3:
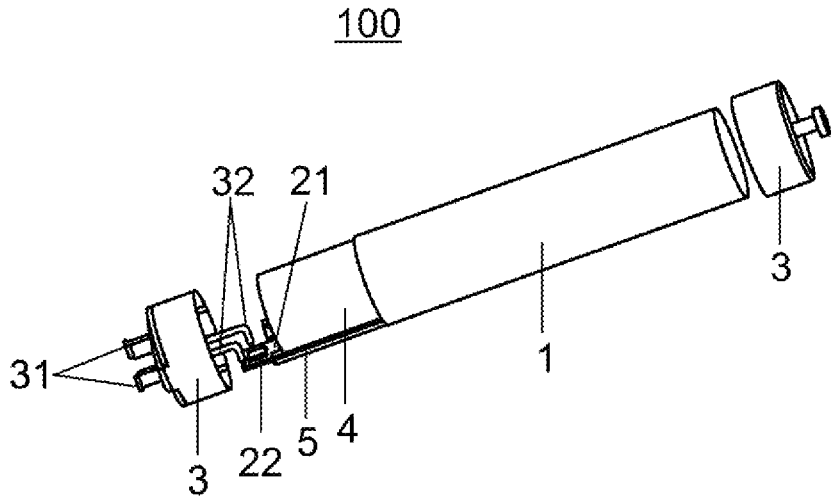
FIG. 3 is a schematic diagram of the lighting device according to the present disclosure in an assembled state, wherein a section of the lamp tube is respectively cut off from the two end regions, so as to clearly show the internal structure of the lighting device.

FIG. 3 shows is a schematic diagram of the lighting device 100 according to various embodiments in an assembled state, wherein a section of the lamp tube is respectively cut off from the two end regions, so as to clearly show the internal structure of the lighting device 100. There is no additional holding structure for the assembly inside the lamp tube 1 in said lighting device 100, while the assembly inside the lamp tube 1 including the diffuser 4 is fixed inside the lamp tube 1 just through the diffuser 4.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

What is claimed is:

1. An assembly configured to be at least partially disposed within a lamp tube of a lighting device, the assembly comprising:

a diffuser element configured to position a light source of the lighting device within the lamp tube, wherein the diffuser element is configured to exert a force on an inner wall of the lamp tube which prevents the diffuser element from moving relative thereto.

2. The assembly of claim 1, wherein the diffuser element is configured to rest on the inner wall of the lamp tube in a predetermined stress.

3. The assembly of claim 1, wherein the diffuser element is configured to be in direct contact with the inner wall of the lamp tube.

4. The assembly of claim 1, wherein the diffuser element is permitted to expand outwardly in a radial direction within the lamp tube.

5. The assembly of claim 1, wherein the diffuser element is provided as an elastic plate-shaped body that is bent into an arcuate form within the lamp tube.

6. The assembly of claim 1, wherein the diffuser element is configured to extend along less than an entire longitudinal length of the lamp tube.

7. The assembly of claim 1, wherein the diffuser element is configured to extend along an entire longitudinal length of the lamp tube.

8. The assembly of claim 1, wherein the diffuser element comprises a transparent elastic material.

9. The assembly of claim 1, wherein the diffuser element includes at least one microstructure configured to enable light passing through the diffuser element to have uniform light distribution performance.

10. The assembly of claim 1, wherein the diffuser element includes a diffusant material configured to enable light passing through the diffuser element to have uniform light distribution performance.

11. The assembly of claim 1, further comprising a carrier configured to support the light source within the lamp tube.

12. The assembly of claim 11, wherein the carrier is held on the diffuser element.

13. The assembly of claim 11, wherein only one edge of the diffuser element is fixed to the carrier, with an opposing edge of the diffuser element being free to move within the lamp tube.

14. The assembly of claim 11, wherein the diffuser element is of arcuate sheet-like form having:

a first edge fixed to a first side of the carrier; and a second edge free to move with respect to a second side of the carrier.

15. The assembly of claim 11, wherein:

a first edge of the diffuser element is operatively interfaced with a first portion of the carrier;

a second edge of the diffuser element is permitted to move freely with respect to a second portion of the carrier; and the first edge and the second edge do not contact one another.

16. The assembly of claim 11, wherein only one edge of the diffuser element is fixed to the carrier such that the diffuser element is permitted to expand and contract along the inner wall of the lamp tube.

17. The assembly of claim 11, wherein the carrier and the diffuser element are fixed in place within the lamp tube using only the diffuser element.

18. The assembly of claim 11, wherein the carrier is further configured to serve as a heat sink for the lighting device.

19. The assembly of claim 11, further comprising the light source, wherein the light source and the diffuser element are fixed in place within the lamp tube using only the diffuser element.

20. A lighting device comprising the assembly of claim 1, wherein the lighting device is configured as any of a T5, T8, and T10 lamp.

* * * * *